US007229261B2

(12) United States Patent
Morimoto et al.

(10) Patent No.: US 7,229,261 B2
(45) Date of Patent: Jun. 12, 2007

(54) SCROLL COMPRESSOR HAVING AN ANNULAR RECESS LOCATED OUTSIDE AN ANNULAR SEAL PORTION AND ANOTHER RECESS COMMUNICATING WITH SUCTION PORT OF FIXED SCROLL

(75) Inventors: Takashi Morimoto, Kyoto (JP); Yoshiyuki Futagami, Shiga (JP); Akira Hiwata, Kyoto (JP); Tsutomu Tsujimoto, Shiga (JP)

(73) Assignee: Matsushita Electric Industrial Co., Ltd., Kadoma-shi (JP)

( * ) Notice: Subject to any disclaimer, the term of this patent is extended or adjusted under 35 U.S.C. 154(b) by 0 days.

(21) Appl. No.: 10/552,579

(22) PCT Filed: Oct. 14, 2004

(86) PCT No.: PCT/JP2004/015550

§ 371 (c)(1),
(2), (4) Date: Oct. 12, 2005

(87) PCT Pub. No.: WO2005/038254

PCT Pub. Date: Apr. 28, 2005

(65) Prior Publication Data

US 2006/0210416 A1 Sep. 21, 2006

(30) Foreign Application Priority Data

Oct. 17, 2003 (JP) ..... 2003-357706
Feb. 17, 2004 (JP) ..... 2004-039421

(51) Int. Cl.
*F03C 2/00* (2006.01)
*F04C 18/00* (2006.01)

(52) U.S. Cl. ..... 418/55.5; 418/55.2; 418/57; 418/75

(58) Field of Classification Search ..... 418/75–77, 418/81, 55.1–55.6, 57
See application file for complete search history.

(56) References Cited

U.S. PATENT DOCUMENTS 4,443,166 A * 4/1984 Ikegawa et al. ..... 418/55.2
5,730,588 A * 3/1998 Terai et al. ..... 418/55.2
5,791,887 A * 8/1998 Williams et al. ..... 418/55.2
6,345,967 B1 * 2/2002 Mukai et al. ..... 418/55.2

FOREIGN PATENT DOCUMENTS

JP 04321701 A * 11/1992 ..... 418/55.2
JP 06137281 A * 5/1994 ..... 418/55.2
JP 2001153068 A * 6/2001
JP 2001-355584 12/2001

* cited by examiner

*Primary Examiner*—Theresa Trieu
(74) *Attorney, Agent, or Firm*—Armstrong, Kratz, Quintos, Hanson & Brooks, LLP

(57) ABSTRACT

A surface of a fixed scroll which is opposed to a end plate of an orbiting scroll existing outside of a lap of the fixed scroll is formed with: a substantially annular seal portion which extends such as to have an outer wall surface of the fixed scroll outwardly extending from an inner wall surface of outermost periphery of the lap substantially along the inner wall surface, and which comes into slide contact with the end plate of the orbiting scroll; a substantially annular recess located outside of the substantially annular seal portion; and a recess which is brought into communication with an intake port of the fixed scroll independently from the substantially annular recess. With this, back pressure of the orbiting scroll is increased, and turning-over phenomenon of the orbiting scroll can be suppressed.

18 Claims, 5 Drawing Sheets

SCROLL COMPRESSOR HAVING AN ANNULAR RECESS LOCATED OUTSIDE AN ANNULAR SEAL PORTION AND ANOTHER RECESS COMMUNICATING WITH SUCTION PORT OF FIXED SCROLL

TECHNICAL FIELD

The present invention relates to a scroll compressor used for a business type, domestic type or vehicular freezer air conditioner, or for a heat pump type water heating system.

BACKGROUND TECHNIQUE

In conventional scroll compressors of this type, opposed surfaces of a fixed scroll and a end plate of an orbiting scroll are provided with an annular seal portion and an annular recess located outside of this seal portion (see patent document 1 for example).

FIG. 6 shows the conventional scroll compressor described in the patent document 1. As shown in FIG. 6, a fixed scroll 202 has a scroll lap 221*b*, and an orbiting scroll (not shown) existing on an outer side of the scroll lap 221*b* has a end plate. An annular seal portion 213 and an annular recess 214 are formed in a surface of the fixed scroll 202 opposed to the end plate. The seal portion 213 extends such as to have an outer wall surface 221*c* which extends from inner wall surfaces 215*a* to 215*d* of outermost periphery of the scroll lap 221*b* substantially along the inner wall surfaces 215*a* to 215*d*, and comes into slide contact with the end plate of the orbiting scroll. The annular recess 214 is located on the outer side of the seal portion 213.

(Patent Document 1)

Japanese Patent Application Laid-open No. 2001-355584

According to the conventional structure, however, even if back pressure is applied to the orbiting scroll, the same back pressure acts on the annular recess 214 and as a result, the back pressure is reduced. Therefore, even if predetermined back pressure force is applied, the back pressure force of the orbiting scroll is prone to be reduced depending upon operating condition of the scroll compressor. With high efficiency tendency of recent freezer air conditioners, scroll compressors are extremely frequently operated with low compression ratio, and there is a problem that the orbiting scroll is separated from the fixed scroll 202 under such operating condition, and the scroll compressor is operated while the orbiting scroll is turned over. Further, in a scroll compressor used for a heat pump type water heating system, the scroll compressor is operated with much lower compression ratio than that of the freezer air conditioner depending upon a water heating condition, and the orbiting scroll is separated from the fixed scroll 202 more frequently.

The present invention has been achieved to solve such conventional problems, and it is an object of the invention to provide a efficient and reliably scroll compressor capable of reducing sliding lost at a thrust portion while suppressing the turning-over phenomenon of the orbiting scroll when the compressor is operated with low compression ratio.

DISCLOSURE OF THE INVENTION

A first aspect of the present invention provides a scroll compressor in which a fixed scroll having a scroll lap and an orbiting scroll having a end plate and a scroll lap are meshed with each other such that the laps of the scrolls come inside, the orbiting scroll turns in a state in which rotation of the orbiting scroll is prevented, a thrust force when the orbiting scroll turns is supported by sliding surfaces between the end plate and the fixed scroll by back pressure force applied to a back surface of the orbiting scroll, wherein a surface of the fixed scroll opposed to the end plate of the orbiting scroll outside of the scroll lap of the fixed scroll is formed with: a substantially annular seal portion which extends such as to have an outer wall surface outwardly extending from an inner wall surface of outermost periphery of the scroll lap of the fixed scroll along the inner wall surface, and which comes into slide contact with the end plate of the orbiting scroll; a substantially annular recess located outside of the substantially annular seal portion; and a recess which is brought into communication with an intake port of the fixed scroll independently from the substantially annular recess.

Conventionally, high pressure, or medium pressure between high pressure and low pressure is applied to the recess for applying back pressure. According to this first aspect, low pressure suction pressure is applied to the recess, an area corresponding to the recess is applied in a direction in which the back pressure of the orbiting scroll is increased, and the turning-over phenomenon of the orbiting scroll can be suppressed even under the operation condition in which there is a tendency that the back pressure is reduced under a low pressure compression ratio operation. Since the recess is formed, necessary substantially annular seal portion is secured, the sliding area at the thrust portion can be reduced and thus, sliding loss can be reduced, compression efficiency can be enhanced under low pressure compression ratio operation, mechanical efficiency and reliability can be enhanced under high-pressure compression ratio operation.

According to a second aspect of the invention, in the scroll compressor of the first aspect, the scroll lap of the fixed scroll is formed of curve which extends from a winding terminal end of the scroll lap of the fixed scroll to a location close to a winding terminal end of the scroll lap of the orbiting scroll, and an inner wall surface of an extension of the curve is continuous with the scroll lap of the fixed scroll.

According to this aspect, since the curve is continuous with the scroll lap of the fixed scroll, the extension thereof is used as a passage of suction stroke or as a portion of compression stroke, and the scroll compressor is operated in some cases such that containment capacities of two compression chambers are different from each other. In such a case, pressure unbalance between the compression chambers is prone to be generated, and there is an adverse possibility that the turning-over phenomenon of the orbiting scroll under low pressure compression ratio operation is accelerated. However, with this aspect, the turning-over phenomenon of the orbiting scroll can be suppressed and the efficiency of the compressor can be enhanced.

According to a third aspect of the invention, in the scroll compressor of the second aspect, the curve which is continuous with the scroll lap of the fixed scroll is the same as a curve which forms the scroll lap of the fixed scroll.

According to this aspect, since the extension of the second aspect functions as the compression chamber not as a suction passage, the pressure unbalance between the two compression chambers is generated in all of operation states. However, since the compression loss at the suction portion is minimized, the extension is frequently used in a scroll compressor which is constituted to enhance the efficiency. In the scroll compressor of such a type, the turning-over phenomenon of the orbiting scroll can be suppressed without a problem of the pressure unbalance between the compression chambers.

According to a fourth aspect of the invention, in the scroll compressor of the first aspect, the substantially annular seal portion is provided with a thin groove which extends to a location close to a winding terminal end of the scroll lap of the orbiting scroll, and the thin groove is brought into communication with the recess.

According to this aspect, when the scroll lap of the fixed scroll extends to a location close to the winding terminal end of the scroll lap of the orbiting scroll from the winding terminal end of the scroll lap of the fixed scroll, the sealing length of the substantially annular seal portion is reduced, and the shape of the recess which is in communication with the intake port is limited in size. If two recesses and two thin grooves are formed and they are brought into communication with each other, suction pressure can be applied to most portion of angle of the end plate of the orbiting scroll, and the turning-over phenomenon of the orbiting scroll can be suppressed more efficiently.

According to a fifth aspect of the invention, in the scroll compressor of the first aspect, a sealing length between the inner wall surface of the recess and an inner wall surface of the fixed scroll at the substantially annular seal portion, or a sealing length between the thin groove and the inner wall surface of the fixed scroll is t/4 or more and 3 t or less when lap thickness of the fixed scroll is defined as "t".

According to this aspect, the sealing length with respect to the inner wall surface of the fixed scroll is t/4 or more and 3 t or less. With this, necessary minimum sealing length can be secured, the communicated recess or thin groove can be maximized, and the turning-over phenomenon of the orbiting scroll can be suppressed more efficiently.

According to a sixth aspect of the invention, in the scroll compressor of the fifth aspect, a sealing length between the inner wall surface of the recess and an inner wall surface of the fixed scroll, or a sealing length between the thin groove and the inner wall surface of the fixed scroll is gradually reduced toward the winding terminal end of the scroll lap of the orbiting scroll.

According to this aspect, the sealing length with respect to the inner wall surface of the fixed scroll can be set in accordance with variation in pressure difference between the compression chamber and the back pressure space, and this structure can be optimized within the operation range of the scroll compressor.

According to a seventh aspect of the invention, in the scroll compressor of the fourth aspect, a depth of the recess or the thin groove is 0.1 mm or more and H/3 mm or less when a lap height of the fixed scroll is defined as Hmm.

According to this aspect, if the depth of the recess or the thin groove is 0.1 mm or more, viscosity loss generated by lubricant oil can be prevented on the thrust sliding surface of the orbiting scroll, and if the depth of the recess or the thin groove is H/3 mm or less, it is possible to prevent problem of deterioration of strength of the scroll lap of the fixed scroll and deterioration of working precision of the lap.

According to an eighth aspect of the invention, in the scroll compressor of the fourth aspect, the depth of the thin groove is smaller than the depth of the recess.

According to this aspect, working resistance when the thin groove is worked or machined can be reduced, and it is unnecessary to reduce the working speed for preventing a tool from being damaged.

According to a ninth aspect of the invention, in the scroll compressor of the first aspect, the scroll compressor is operated with compression ratio which is smaller than design compression ratio determined by scroll laps of the fixed scroll and orbiting scroll and the like.

According to this aspect, it is possible to enhance the efficiency also in a scroll compressor in which suppression of the turning-over phenomenon of the orbiting scroll enhances compression efficiency in the operation range and makes it difficult to stabilize, and it is possible to further enhance the efficiency also in a scroll compressor which is operated under low compression ratio in a recent efficient freezer air conditioner.

According to a tenth aspect of the invention, in the scroll compressor of any one of the first to ninth aspects, high pressure refrigerant, e.g., carbon dioxide is used as refrigerant.

According to this aspect, it is possible to prevent sliding loss from being increased also in a scroll compressor in which the back pressure of the orbiting scroll is excessively great and there is a tendency that the sliding loss at the thrust sliding portion is increased. In a heat pump water heating system using carbon dioxide as refrigerant, the scroll compressor is operated with extremely low compression ratio in some cases due to characteristics of the system, and it is possible to provide an efficient scroll compressor even under such a using condition.

BEST MODE FOR CARRYING OUT THE INVENTION (First Embodiment)

Embodiments of the present invention will be explained with reference to the drawings. It should be noted that the invention is not limited by the embodiments.

Figure 1:
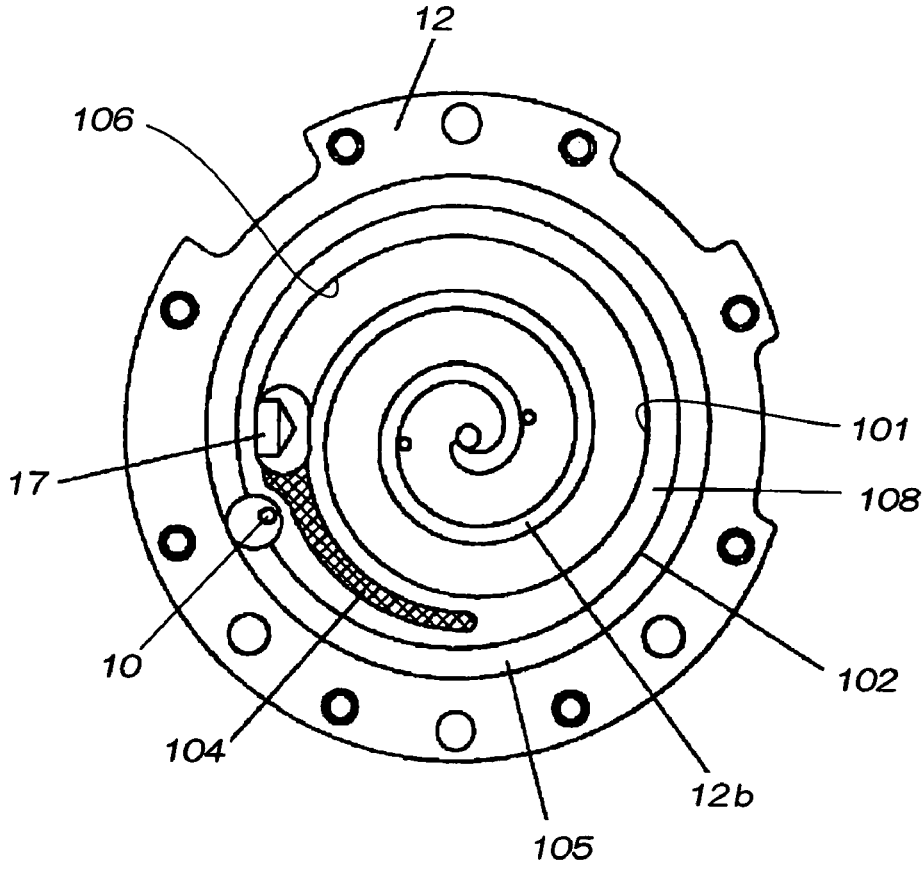
FIG. 1 is a plan view of a fixed scroll which is an essential portion of a scroll compressor of a first (and a second) embodiments of the present invention.
Figure 2:
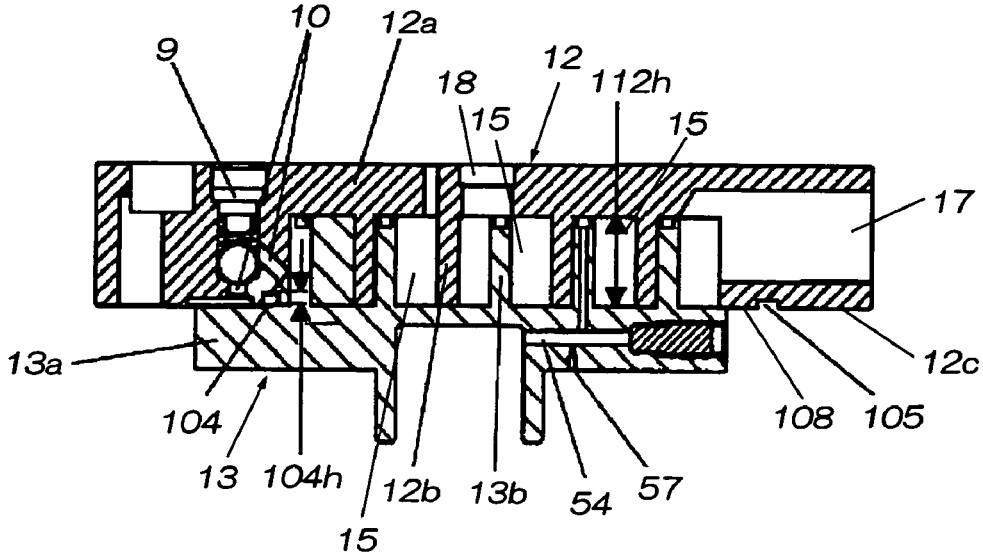
FIG. 2 is an enlarged vertical sectional view of the scroll compressor shown in FIG. 1.
Figure 3:
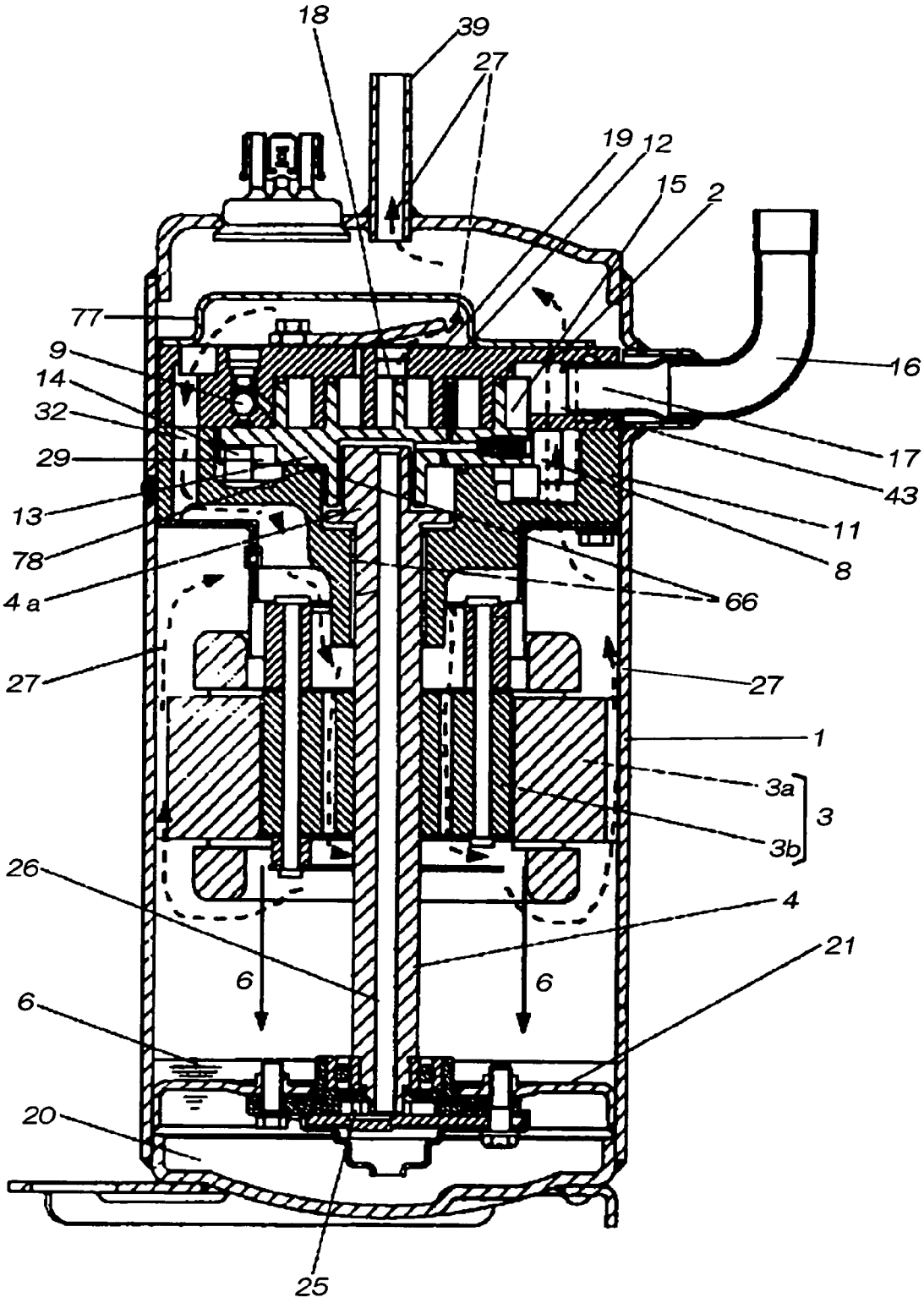
FIG. 3 is a vertical sectional view of the scroll compressor of the first embodiment.

FIG. 1 is a plan view of a fixed scroll which is an essential portion of a scroll compressor of a first embodiment of the present invention, FIG. 2 is an enlarged vertical sectional view of the scroll compressor shown in FIG. 1, and FIG. 3 is a vertical sectional view of the scroll compressor of the first embodiment of the invention.

In FIGS. 1 and 2, in the scroll compressor of this embodiment, a fixed scroll 12 has a scroll lap 12*b*, and an orbiting scroll 13 located on the outer side of the scroll lap 12*b* has a end plate 13*a*. A surface of the fixed scroll 12 opposed to the end plate 13*a* is formed with a substantially annular seal portion 108, a substantially annular recess 105 located outward of the substantially annular seal portion 108, and a recess 104 (meshed portion in FIG. 1) which is in communication with an intake port 17 of the fixed scroll 12 independently from the substantially annular recess 105. The substantially annular seal portion 108 outwardly extends such as to have an outer wall surface 102 which extends from an outermost peripheral inner wall surface 101 of the scroll lap 12*b* of the fixed scroll 12 substantially along the inner wall surface 101. The substantially annular seal portion 108 comes into slide contact with the end plate 13*a* of the orbiting scroll 13.

The operation and function of the scroll compressor having the above-described structure will be explained below.

In the scroll compressor of the embodiment, as shown in FIGS. 1 to 3, a lap 12*b* rising from a end plate 12*a* of the fixed scroll 12 and a scroll lap 13*b* rising from the end plate 13*a* of the orbiting scroll 13 mesh with each other and a compression chamber 15 is formed therebetween. When the orbiting scroll 13 is turned along a circular orbit while restraining rotation by a rotation-restricting mechanism 14, the compression chamber 15 moves while changing its volume, thereby carrying out suction, compression and discharge operations. At that time, predetermined back pressure is applied to a back surface, especially outer peripheral portion of the orbiting scroll 13, and the orbiting scroll 13 is not separated from the fixed scroll 12 and turned, and the suction, compression and discharge operations are stably carried out.

In the case of the illustrated example, a plurality of compression chambers 15 are formed, the volume of the compression chamber 15 is reduced while the compression chamber 15 is moved from outer peripheral sides of the fixed scroll 12 and the orbiting scroll 13 toward their centers, refrigerant is sucked from the intake port 17 provided in the outer periphery of the fixed scroll 12, the compression chamber 15 moves toward the centers and compresses the refrigerant gradually, and discharges the refrigerant from a discharge port 18 formed in the central portion of the fixed scroll 12. The discharge port 18 is provided with a reed valve 19. Whenever pressure of compressed refrigerant becomes equal to or greater than predetermined pressure, the reed valve 19 is opened to discharge the refrigerant, thereby securing the discharge pressure of the refrigerant.

In one example of a case in which a scroll compressor is used for a freezer air conditioner or a freezer, the back pressure is applied by supply pressure of lubricant oil 6 to be supplied to a back pressure chamber 29 provided in a central back surface of the orbiting scroll 13, but the present invention is not limited to this. Another back pressure fluid may be used depending upon difference in use of the scroll compressor or operating type of the scroll compressor.

To secure the back pressure, as shown in FIGS. 1 and 2, the fixed scroll 12 has the scroll lap 12*b*, and the orbiting scroll 13 located on the outer side of the scroll lap 12*b* has the end plate 13*a*. The surface of the fixed scroll 12 opposed to the end plate 13*a* is formed with the substantially annular seal portion 108, the substantially annular recess 105 located outward of the substantially annular seal portion 108, and the recess 104 which is in communication with the intake port 17 of the fixed scroll 12 independently from the substantially annular recess 105. The substantially annular seal portion 108 outwardly extends such as to have the outer wall surface 102 which extends from the outermost peripheral inner wall surface 101 of the scroll lap 12*b* substantially along the inner wall surface 101. The substantially annular seal portion 108 comes into slide contact with the end plate 13*a* of the orbiting scroll 13. More specifically, the recess 104 is mechanically formed, or may be cast in a raw material stage of the fixed scroll 12, or may be formed by both casting and mechanical working.

According to the above structure, as the scroll compressor carries out the suction, compression and discharge operations, the substantially annular seal portion 108 is formed widely while keeping necessary distance outward from the inner wall surface 101 of the lap 12*b* of the fixed scroll 12 required for sealing as shown in FIG. 1. The suction pressure is always applied to the recess 104 which is in communication with the intake port 17 of the fixed scroll 12. A pressing force of the fixed scroll 12 is applied to a portion of the end plate 13*a* of the orbiting scroll 13 which is opposed to and contacted with the recess 104 due to pressure difference between the suction pressure and the applied back pressure.

As a result of the above factors, the back pressure force of the orbiting scroll 13 is increased, and it is possible to restrain or suppress the turning-over phenomenon of the orbiting scroll 13 even when the scroll compressor is operated with low pressure compression ratio. Further, since the recess 104 is formed, the sliding area at the thrust portion can be reduced while securing the necessary substantially annular seal portion 108, and the sliding loss can be reduced.

Although the recess 104 has a relatively complicated shape in this embodiment, the same effect can be expected even if the recess 104 has a straight shape which can easily be formed.

A communication passage 10 is provided in the fixed scroll 12. The communication passage 10 connects a back pressure side and a low pressure side of the compression chamber 15. The communication passage 10 is provided at its intermediate portion with a back pressure adjusting mechanism 9. The back pressure adjusting mechanism 9 releases back pressure fluid toward the low pressure side when pressure of the back pressure side exceeds a predetermined intermediate pressure. The communication passage 10 opens at the back pressure side in the substantially annular recess 105. With this structure, the communication passage 10 is always in communication with the back pressure side through the substantially annular recess 105. Thus, the adjustment operation of the back pressure by the back pressure adjusting mechanism 9 is not interrupted, and the back pressure fluid is released toward the low pressure side of the compression chamber 15 whenever the pressure of the back pressure fluid exceeds the predetermined value. Therefore, when the back pressure fluid is oil 6, the oil 6 is effective for lubricating and sealing the lubricating parts around the compression chamber 15, and the performance of the scroll compressor is enhanced and stabilized.

The scroll compressor of this embodiment is one example of a so-called hermetic scroll compressor which is connected to a refrigeration cycle apparatus and provided in a container 1. This scroll compressor is mainly used in a maintenance free manner. Although the scroll compressor is illustrated as being disposed vertically, it may be disposed laterally in some cases.

As shown in FIG. 3, the scroll compressor is provided on an upper portion of the container 1, and is fixed by a main bearing member 11 which supports upwardly extending one end of a crankshaft 4. The main bearing member 11 is mounted on an inner periphery of the container 1 by means of shrinkage fit or welding, and the fixed scroll 12 is bolted to the main bearing member 11. The orbiting scroll 13 is sandwiched between the main bearing member 11 and the fixed scroll 12 and meshed with the fixed scroll 12, and the compression chamber 15 is formed between the orbiting scroll 13 and the fixed scroll 12. An Oldham ring as the rotation-restricting mechanism 14 is provided between the orbiting scroll 13 and the main bearing member 11. The rotation-restricting mechanism 14 restrains rotation of the orbiting scroll 13 between the main bearing member 11 and the rotation-restricting mechanism 14. Other known member or mechanism can be employed as the rotation-restricting mechanism 14.

A motor 3 is also provided in the container 1 to drive the scroll compressor. The motor 3 includes a stator 3*a* which is fixed to an inner periphery of the container 1 by means of shrinkage fit or welding, and a rotor 3*b* located inside of the stator 3*a*. The rotor 3*b* is fixed to the crankshaft 4. The other end of a portion of the crankshaft 4 which is fixed to the stator 3*a* and which extends downward is rotatably received by an auxiliary bearing member 21 which is fixed to the inner periphery of the container 1 by means of welding.

The crankshaft 4 is provided at its upper end with an eccentric shaft portion 4*a*. The eccentric shaft portion 4*a* is fitted into the orbiting scroll 13. If the crankshaft 4 is rotated by the motor 3, the crankshaft 4 turns the orbiting scroll 13 along a predetermined circular orbit in cooperation with the rotation-restricting mechanism 14.

The downwardly oriented other end of the crankshaft 4 is provided with a pump 25. The pump 25 is driven simultaneously with the scroll compressor. With this, the pump 25 pumps up oil 6 existing in the oil reservoir 20 provided in the bottom of the container 1, and supplies the oil 6 to a back pressure chamber 29 through an oil supply hole 26 which passes through the crankshaft 4 vertically. The supply pressure at that time is almost equal to the discharge pressure of the scroll compressor, and also functions as a back pressure source with respect to the outer periphery of the orbiting scroll 13. With this, the orbiting scroll 13 is not separated from the fixed scroll 12 or turned over even by compression, and the orbiting scroll 13 can stably exhibit predetermined compressing function.

A portion of the oil 6 supplied to the back pressure chamber 29 enters the eccentric shaft portion 4*a*, a fitting portion of the orbiting scroll 13, and a bearing 66 between the crankshaft 4 and the main bearing member 11, and the oil 6 lubricates these portions and then drops and returns to the oil reservoir 20 such that the oil 6 seeks an escaping place due to supply pressure or its own weight. Another portion of the oil 6 supplied to the back pressure chamber 29 passes through a passage 54, and is branched into sliding portions between the meshed fixed scroll 12 and the orbiting scroll 13, and an annular space 8 around the outer periphery of the orbiting scroll 13 where the rotation-restricting mechanism 14 is located, and this oil 6 lubricates the meshed sliding portions and a sliding portion of the rotation-restricting mechanism 14, and applies the back pressure of the orbiting scroll 13 in the annular space 8.

The pressure of the oil 6 which enters the annular space 8 is set to medium pressure which is between the back pressure and pressure on the low pressure side in the compression chamber 15 by a diameter-reducing function of a diameter-reduced portion 57. A space between a high pressure side of the back pressure chamber 29 and the annular space 8 is sealed by an annular partition band 78. As the entering oil is filled, its pressure is increased and if the pressure exceeds a predetermined value, the back pressure adjusting mechanism 9 is operated and the oil 6 is returned to the low pressure side in the compression chamber 15 and enters. This entering operation of the oil 6 is repeated in a predetermined cycle, and this repeating timing is determined by a combination of repeating cycle of the suction, compression and discharge operations, and a relation between a pressure reducing setting by the diameter-reduced portion 57 and the pressure setting at the back pressure adjusting mechanism 9, and the meshed sliding portions between the fixed scroll 12 and the orbiting scroll 13 are intentionally lubricated. This intentional lubrication is always secured by opening of the communication passage 10 toward the substantially annular recess 105 as described above. The oil 6 supplied to the intake port 17 moves into the compression chamber 15 together with the turning motion of the orbiting scroll 13, and this prevents leakage between the compression chambers 15.

The refrigerant discharged from the compression mechanism 2 flows like refrigerant gas 27 shown with broken lines in FIG. 3. The refrigerant enters into a muffler 77 bolted on the compression mechanism 2 and then, flows below the compression mechanism 2 through a compression mechanism communication passage 32, reaches a location below the motor 3 through the rotor 3*b* of the motor 3 while turning, and shakes down the oil 6 by centrifugal separation and returns the oil 6 into the oil reservoir 20. The refrigerant separated from the oil 6 reaches a location above the motor 3 through the stator 3*a* of the motor 3 and then, reaches a location above the muffler 77 through another compression mechanism communication passage 43, and is discharged out from the container 1 from an external discharge port 39, and is supplied to the refrigeration cycle. The refrigerant which passes through the refrigeration cycle is returned into the intake pipe 16 of the container 1, and is sucked into the compression chamber 15 from the intake port 17, and these operations are repeated thereafter.

(Second Embodiment)

A scroll compressor of a second embodiment of the present invention will be explained using FIGS. 1 and 2.

According to the scroll compressor of this embodiment, the lap 12*b* of the fixed scroll 12 extends from its winding terminal end to a winding terminal end area of a lap 13*b* of the orbiting scroll 13, and an inner wall surface of an extension of the lap 12*b* is formed of curve 106 which is continuous with the lap 12*b* of the fixed scroll 12.

In the case of the scroll compressor of this embodiment, the extension can be used as a passage of the suction stroke or can be used as a portion of the compression stroke. In an example of the latter case, a gap in the vicinity of the continuous curve 106 and the winding terminal of the lap 13*b* of the orbiting scroll 13 is set to a very small value, and the scroll compressor is operated while changing the capacity of the compression chamber 15 in a pseudo manner in accordance with the operation speed of the scroll compressor.

In such a case, the scroll compressor is operated in such a manner that containment capacities of the two compression chambers 15 are different from each other, and the containment capacity of the compression chamber 15 surrounded by the inner wall surface 101 of the lap 12*b* of the fixed scroll 12, and the containment capacity of the compression chamber 15 surrounded by the inner wall surface of the lap 13*b* of the orbiting scroll 13 are different from each other when the suction stroke is completed. That is, the containment capacity of the compression chamber 15 surrounded by the inner wall surface 101 of the lap 12*b* of the fixed scroll 12 becomes greater. In this state, as the compression stroke proceeds, unbalance between the pressures of the two compression chambers 15 is generated, a turning-over moment which tries to separate the orbiting scroll 13 from the fixed scroll 12 is generated and as a result, there is an adverse possibility that the turning-over phenomenon of the orbiting scroll 13 is accelerated under the low pressure compression operation.

However, also in the scroll compressor of the second embodiment like the first embodiment, since the back pressure applied to the orbiting scroll 13 is increased and the turning-over phenomenon can be restrained, it becomes possible to operate the scroll compressor while changing the capacity of the compression chamber 15 in the pseudo manner in accordance with the operation speed, and it is possible to provide an efficient scroll compressor.

When the curve which is continuous with the lap 12*b* of the fixed scroll 12 is the same as a curve forming the lap 12*b* of the fixed scroll 12, the scroll compressor is operated in a state in which the containment capacities of the two compression chambers 15 are always different from each other irrespective of the operation speed. Thus, pressure unbalance between the compression chambers 15 is always generated, and the turning-over phenomenon of the orbiting scroll 13 is further accelerated.

However, according to the scroll compressor of this embodiment, since the turning-over phenomenon can stably be restrained from the low speed operation time in which the back pressure force applied to the orbiting scroll 13 is small, the scroll compressor can be operated in the state in which the containment capacities of the two compression chambers 15 are always different from each other, the compression loss at the suction portion can be suppressed to a minimum value, and high efficiency can be obtained.

(Third Embodiment)

Figure 4:
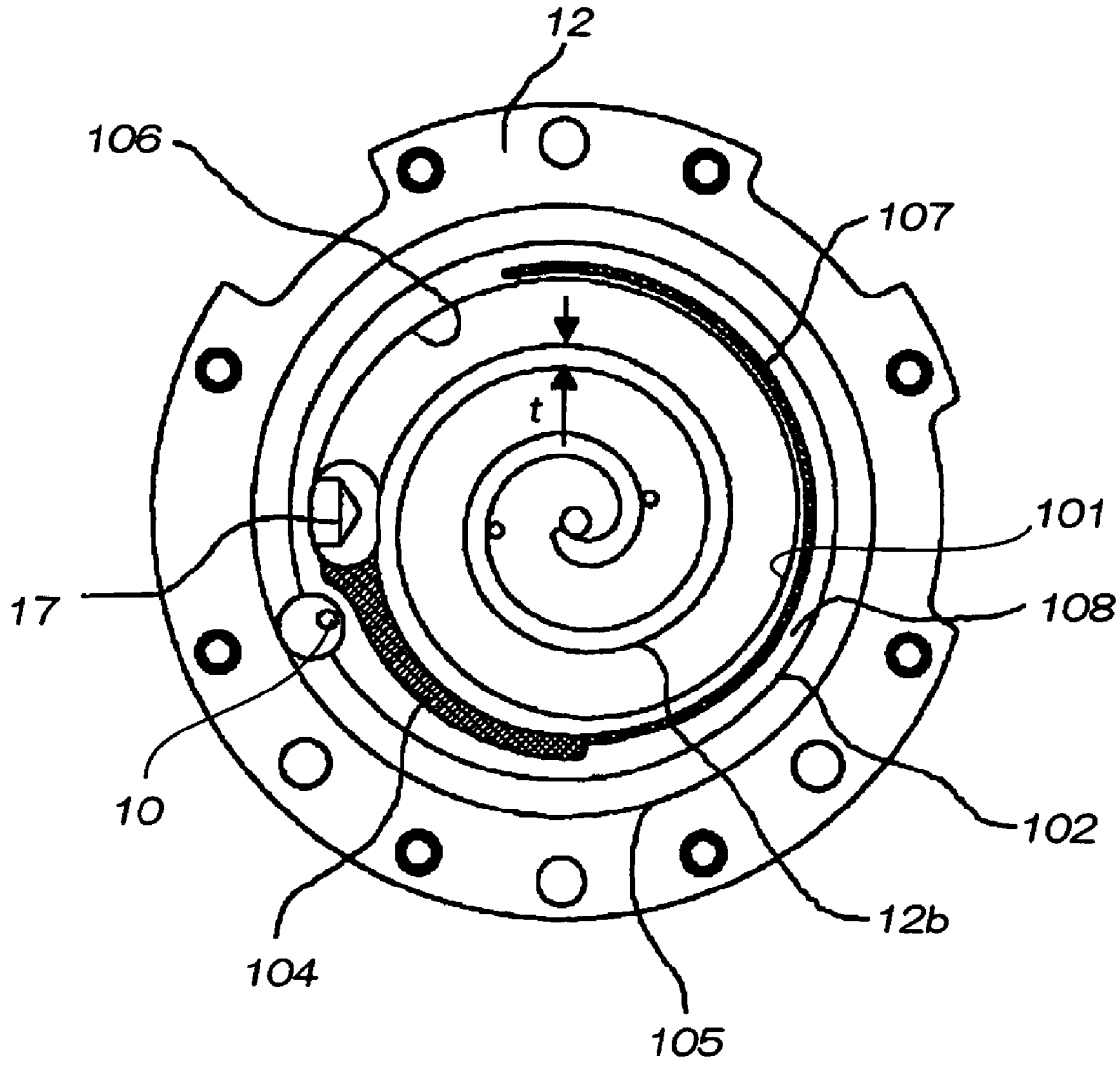
FIG. 4 is a plan view of a fixed scroll which is an essential portion of a scroll compressor of a third (and a fourth) embodiments of the invention.

A scroll compressor of a third embodiment of the present invention will be explained. FIG. 4 is a plan view of a fixed scroll which is an essential portion of the scroll compressor of the third embodiment of the invention.

As shown in FIG. 4, according to the scroll compressor of this embodiment, the substantially annular seal portion 108 is provided with a thin groove 107 extending to a location in the vicinity of the winding terminal end of the lap 13*b* of the orbiting scroll 13, and the thin groove 107 is brought into communication with a recess 104 which is in communication with the intake port 17. That is, suction pressure is applied to the thin groove 107, and suction pressure enters from a most angle range of the substantially annular seal portion 108.

Therefore, according to the scroll compressor of this embodiment, suction pressure can be applied to most portion of the end plate 13*a* of the orbiting scroll 13, back pressure application force in a partial angle section is not increased, and the back pressure application force in the most angle range can be increased. Thus, the turning-over phenomenon of the orbiting scroll 13 can be suppressed more efficiently.

When the lap 12*b* of the fixed scroll 12 extends to a location near the winding terminal end of the lap 13*b* of the orbiting scroll 13, a sealing length of the substantially annular seal portion 108 is shortened, and the shape of the recess 104 which is in communication with the intake port 17 is limited in size. In such a case, if two recesses 104 and two thin grooves 107 are formed and they are brought into communication with each other, this limitation in structure can be avoided.

As a concrete example of this embodiment, the recess 104 may previously be formed by casting in a raw material stage of the fixed scroll 12, and the thin groove 107 may be machined such that the thin groove 107 is brought into communication with the cast recess 104.

Figure 5:
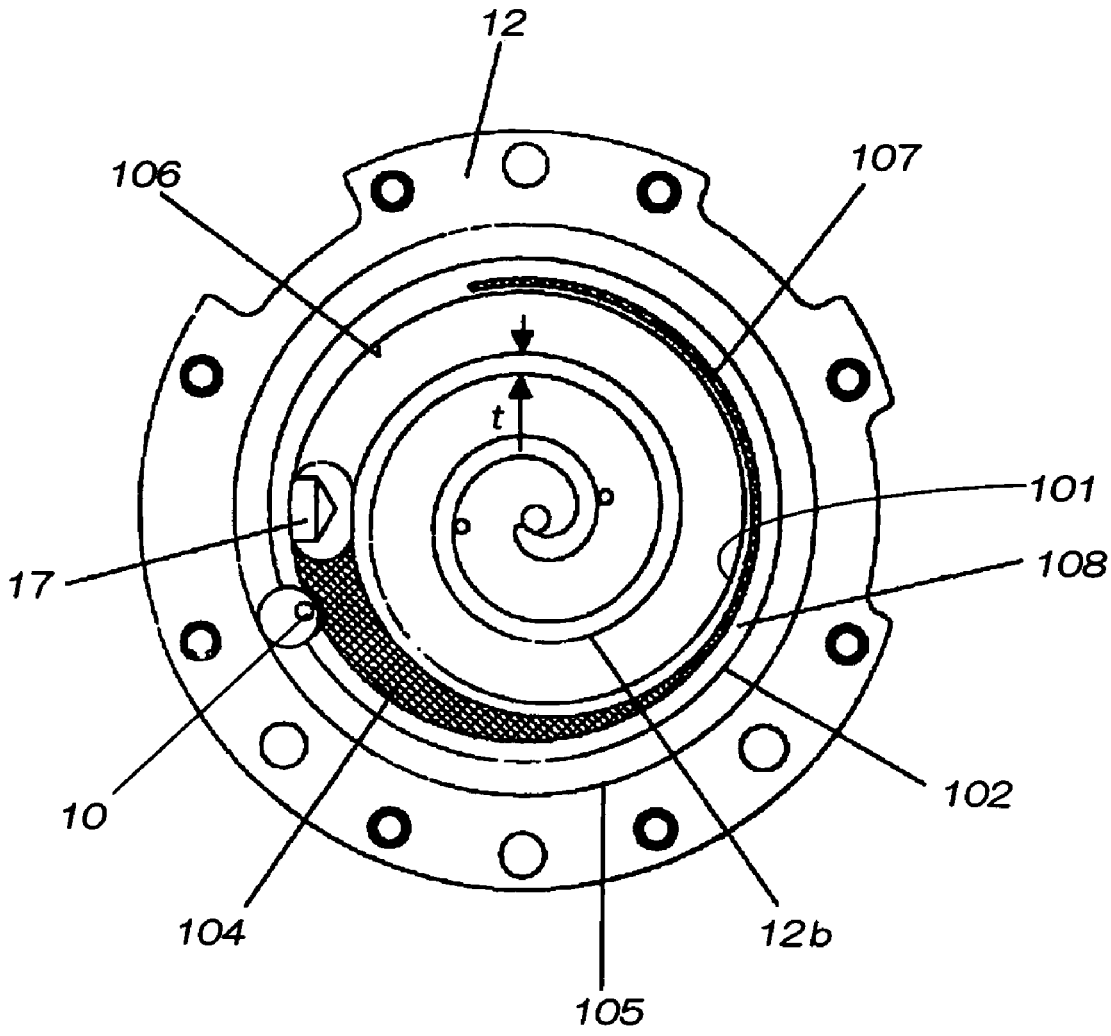
FIG. 5 is a plan view of a fixed scroll which is an essential portion of a scroll compressor of another embodiment.
Figure 6:
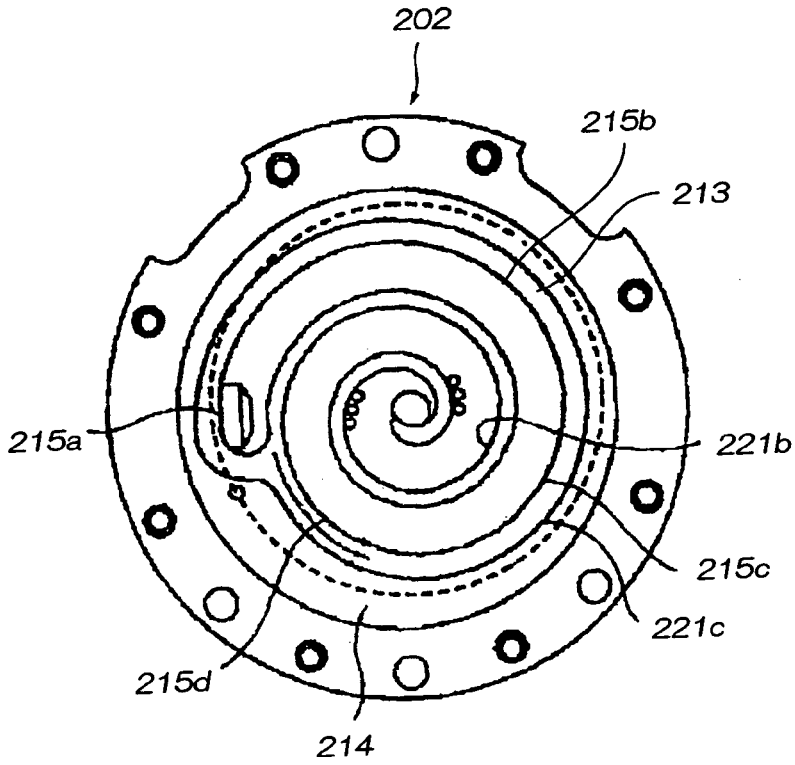
Prior Art Fig. 6
FIG. 6 is a plan view of a fixed scroll which is an essential portion of a conventional scroll compressor.

Alternatively, like a fixed scroll of a scroll compressor of another embodiment shown in FIG. 5, the thin groove 107 may be formed substantially integrally with the recess 104. In this case, all of them may be mechanically formed, or may be cast in a raw material stage, or may be formed by both casting and mechanical working. In either case, the same effect as that of the third embodiment can be obtained.

(Fourth Embodiment)

A scroll compressor of a fourth embodiment of the present invention will be explained using FIG. 4.

In the scroll compressor of the fourth embodiment shown in FIG. 4, in the substantially annular seal portion 108, if a sealing length between the inner wall surface of the recess 104 and the inner wall surface 101 of the fixed scroll 12, or a sealing length between the thin groove 107 and the inner wall surface 101 of the fixed scroll 12 is defined as "S", and if the thickness of the lap of the fixed scroll 12 is defined as "t", a relation t/4(S(3 t is established.

That is, the thickness of the lap of the fixed scroll 12 is "t", and the sealing length between the compression chambers 15 is sufficient, but pressure in the compression chamber 15 in the substantially annular seal portion 108 does not rise so much, sealing necessary pressure difference may be lower than pressure in the compression chamber 15. It has been confirmed by experiment that when there is t/4 or more sealing length, leakage into the recess 104 or the thin groove 107 to which suction pressure is applied from the compression chamber 15 can be suppressed to such a value that there is no influence. However, when the surface precision of the seal portion is inferior, e.g., when the surface precision of the end plate 13*a* of the orbiting scroll 13 is inferior, it is necessary that the sealing length is t/4 or more.

To secure the sealing performance and to enhance the application force of back pressure, it is preferable that the sealing length is 3 t or less. Therefore, if the sealing length of the substantially annular seal portion 108 of the fixed scroll 12 is set in a range between t/4 or more and 3 t or less, necessary minimum sealing length can be secured, and the communicated recess or thin groove can be set at a maximum value.

According to the scroll compressor of this embodiment, as described above, it is possible to suppress the leakage from the compression chamber 15 and to effectively suppress the turning-over phenomenon of the orbiting scroll 13 by limiting the sealing length of the substantially annular seal portion 108.

When the pressure rising degree of the compression chamber 15 is taken into consideration, since the sealing necessary pressure difference is gradually reduced toward the winding terminal end of the lap 13*b* of the orbiting scroll 13, in the scroll compressor of this embodiment, if the sealing length between the inner wall surface of the recess 104 and the inner wall surface 101 of the fixed scroll 12, or the sealing length between the thin groove 107 and the inner wall surface 101 of the fixed scroll 12 is set such that the sealing length is gradually reduced toward the winding terminal end of the lap 13*b* of the orbiting scroll 13, the above effect can further be enhanced.

(Fifth Embodiment)

A scroll compressor of a fifth embodiment of the present invention will be explained using FIGS. 1 and 2.

In the scroll compressor of the fifth embodiment, depth 104*h* of the recess 104 which is in communication with the intake port 17 of the fixed scroll 12 is 0.1 mm or more and H/3 mm or less when lap height (i.e., lap groove depth) of the fixed scroll 12 is defined as Hmm.

That is, if the depth 104*h* is 0.1 mm or more, it is possible to prevent viscosity loss generated by oil 6 or the like which is back pressure fluid in a sliding surface of the orbiting scroll 13. If the depth 104*h* is suppressed to H/3 mm or less, it is possible to avoid a problem of deterioration of working precision caused by deterioration of strength or rigidity of the lap 12*b* of the fixed scroll 12.

According to the scroll compressor of this embodiment, the sliding area at the thrust portion can be suppressed, the viscosity loss can be minimized, and it is possible to suppress the increase in compression loss caused by deterioration of the working precision of the lap 12*b* of the fixed scroll 12.

In the scroll compressor of this embodiment shown in FIG. 4 also, it is preferable that the depth 104*h* of the recess 104 which is in communication with the intake port 17 of the fixed scroll 12 is 0.1 mm or more and H/3 mm or less when the lap height (i.e., lap groove depth) of the fixed scroll 12 is defined as 112*h*. In this case, it is preferable that the depth of the thin groove 107 is also 0.1 mm or more and H/3 mm or less when the lap height (i.e., lap groove depth) of the fixed scroll 12 is defined as Hmm.

In the scroll compressor of this embodiment, by setting the depth of the thin groove 107 smaller than the depth of the recess 104 which is in communication with the intake port 17 of the fixed scroll 12, it is possible to reduce the working resistance when the thin groove 107 is worked, it becomes unnecessary to reduce the working speed to prevent a tool from being damaged, and the working and producing speed can be increased.

(Sixth Embodiment)

A scroll compressor of a sixth embodiment of the present invention is the scroll compressor (not shown) of any of first to fifth embodiments which is operated at smaller compression ratio than design compression ratio determined by the laps 12*b* and 13*b* of the fixed scroll 12 and the orbiting scroll 13 and the like.

In the case of a scroll compressor used for a domestic freezer air conditioner or the like, a compression ratio having high operation frequency is about 1.5 to 4.0 in many cases. In the case of an operation speed variable type scroll compressor, design compression ratio determined by the laps 12*b* and 13*b* and the like is set to about 1.8 to 3.0 in many cases. Business type air conditioners do not fall in these ranges, and design compression ratio is set greater in some cases. When attempt is made to suppress the turning-over phenomenon of the orbiting scroll 13 with the operation compression ratio of about 1.5 to 2.0, it becomes necessary to increase the back pressure of the orbiting scroll 13. In such setting, in many cases, the sliding loss is increased due to excessively large back pressure at the high pressure ratio region (about compression ratio of 2.5 or more).

Even if the scroll compressor of any of the first to fifth embodiments is operated with a compression ratio which is smaller than the design compression ratio determined by the laps 12*a* and 13*a* of the fixed scroll 12 and the orbiting scroll 13 and the like (about 1.8 to 3.0 in the case of a scroll compressor used for a domestic freezer air conditioner), it is possible to suppress the turning-over phenomenon of the orbiting scroll 13, the efficiency of the scroll compressor can be enhanced in a compression ratio region where the operation frequency is high, and the efficiency can further be enhanced even in a recent efficient freezer air conditioner in which the scroll compressor is operated with low compression ratio in many cases.

(Seventh Embodiment)

A scroll compressor of a seventh embodiment of the present invention uses high pressure refrigerant, e.g., carbon dioxide as the refrigerant (not shown). The scroll compressor of this embodiment has a merit that it is possible to prevent the sliding loss from being increased, and environmentally friendly carbon dioxide can be used as refrigerant even if the back pressure of the orbiting scroll 13 is excessively increased and there is a tendency that the sliding loss at the thrust sliding portion is increased.

In a heat pump water heating system using carbon dioxide as refrigerant, the scroll compressor is operated with extremely low compression ratio (about 1.5 or less) due to its characteristics. It is possible to provide an efficient scroll compressor even under such using condition.

According to the scroll compressor of the present invention, it is possible to enhance the compression efficiency and a circulation amount of refrigerant under the low compression ratio operation, and to enhance the mechanical efficiency under high compression ratio operation, and it is possible to enhance the efficiency and reliability of a freezer air conditioner.

INDUSTRIAL APPLICABILITY

According to the scroll compressor of the present invention, as described above, it is possible to enhance the compression efficiency under low compression ratio operation, and to enhance the mechanical efficiency under high compression ratio operation, and it is possible to expect that new alternative refrigerant, new refrigerant, natural refrigerant and the like which will be used in the future can be used in the scroll compressor.

The invention claimed is:

1. A scroll compressor in which a fixed scroll having a scroll lap and an orbiting scroll having an end plate and a scroll lap are meshed with each other such that the laps of the scrolls come inside, said orbiting scroll turns in a state in which rotation of the orbiting scroll is prevented, a thrust force when the orbiting scroll turns is supported by sliding surfaces between said end plate and said fixed scroll by back pressure force applied to a back surface of said orbiting scroll, wherein a surface of said fixed scroll opposed to said end plate of said orbiting scroll outside of the scroll lap of said fixed scroll is formed with: a substantially annular seal portion which extends such as to have an outer wall surface outwardly extending from an inner wall surface of outermost periphery of said scroll lap of said fixed scroll along the inner wall surface, and which comes into slide contact with said end plate of said orbiting scroll; a substantially annular recess located outside of said substantially annular seal portion; and a recess which is brought into communication with an intake port of said fixed scroll independently from said substantially annular recess.

2. The scroll compressor according to claim 1, wherein said scroll lap of said fixed scroll is formed of curve which extends from a winding terminal end of said scroll lap of said fixed scroll to a location close to a winding terminal end of said scroll lap of said orbiting scroll, and an inner wall surface of an extension of said curve is continuous with said scroll lap of said fixed scroll.

3. The scroll compressors according to claim 2, wherein said curve which is continuous with said scroll lap of said fixed scroll is the same as a curve which forms said scroll lap of said fixed scroll.

4. The scroll compressor according to claim 3, wherein high pressure refrigerant is carbon dioxide.

5. The scroll compressor according to claim 2, wherein high pressure refrigerant is carbon dioxide.

6. The scroll compressor according to claim 1, wherein said substantially annular seal portion is provided with a thin groove which extends to a location close to a winding terminal end of said scroll lap of said orbiting scroll, and the thin groove is brought into communication with said recess.

7. The scroll compressor according to claim 6, wherein a depth of said recess or said thin groove is 0.1 mm or more and H/3 mm or less when a lap height of said fixed scroll is defined as Hmm.

8. The scroll compressor according to claim 7, wherein high pressure refrigerant is carbon dioxide.

9. The scroll compressor according to claim 6, wherein the depth of said groove is smaller than the depth of said recess.

10. The scroll compressor according to claim 9, wherein high pressure refrigerant is carbon dioxide.

11. The scroll compressor according to claim 6, wherein high pressure refrigerant is carbon dioxide.

12. The scroll compressor according to claim 1, wherein a sealing length between the inner wall surface of said recess and an inner wall surface of said fixed scroll at said substantially annular seal portion, or a sealing length between said thin groove and the inner wall surface of said fixed scroll is t/4 or more and 3 t or less when lap thickness of said fixed scroll is defined as "t."

13. The scroll compressor according to claim 12, wherein a sealing length between the inner wall surface of said recess and an inner wall surface of said fixed scroll, or a sealing length between said thin groove and the inner wall surface of said fixed scroll is gradually reduced toward the winding terminal end of said scroll lap of said orbiting scroll.

14. The scroll compressor according to claim 13, wherein high pressure refrigerant is carbon dioxide.

15. The scroll compressor according to claim 12, wherein high pressure refrigerant is carbon dioxide.

16. The scroll compressor according to claim 1, wherein said scroll compressor is operated with compression ratio which is smaller than design compression ratio determined by scroll laps of said fixed scroll and orbiting scroll.

17. The scroll compressor according to claim 16, wherein high pressure refrigerant is carbon dioxide.

18. The scroll compressor according to claim 1, wherein high pressure refrigerant is carbon dioxide.

* * * * *